US006636457B2

(12) United States Patent
Lin

(10) Patent No.: US 6,636,457 B2
(45) Date of Patent: Oct. 21, 2003

(54) CLOCK MOVEMENT WITH A DISPLAY FOR WORLD TIME ZONES

(75) Inventor: Wen-Chun Lin, Taipei Hsien (TW)

(73) Assignee: Atop Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/945,843

(22) Filed: Sep. 5, 2001

(65) Prior Publication Data

US 2003/0016589 A1 Jan. 23, 2003

(30) Foreign Application Priority Data

Jul. 17, 2001 (TW) ..... 090117521

(51) Int. Cl.[7] ..... G04B 19/22

(52) U.S. Cl. ..... 368/21; 368/22; 368/26; 368/27

(58) Field of Search ..... 368/21, 22, 26–27

(56) References Cited

U.S. PATENT DOCUMENTS 3,675,411 A * 7/1972 Sakuma ..... 368/192
4,945,521 A * 7/1990 Klaus ..... 368/185
5,210,721 A * 5/1993 Kikuchi ..... 368/21
5,339,293 A * 8/1994 Kamiyama et al. ..... 368/21
5,383,165 A * 1/1995 Vaucher ..... 368/185
5,631,878 A * 5/1997 Chen ..... 368/21
5,745,440 A * 4/1998 Chen ..... 368/21

* cited by examiner

*Primary Examiner*—David Martin
*Assistant Examiner*—Michael L. Lindinger
(74) *Attorney, Agent, or Firm*—Troxell Law Office PLLC

(57) ABSTRACT

A clock movement with a display for world time zones comprises a power source, a second counter, a minute counter, an hour counter, and a time zone display. The time zone display further comprises an intermediate base, a time zone adjustable ring, and a dial plate. The intermediate base provides a planetary basic gear axially attached to the central of the bottom thereof to be passed through by a minute wheel set. The planetary basic gear at a lower side thereof connects with an axial stem provided a front hour wheel and a join ring at a lower periphery thereof. The join ring at a periphery thereof extends at least two circumferential elastic engaging hooks. The time zone adjustable ring provides an inner gear ring part to mesh with the planetary basic gear. An inner ratchet ring with a plurality of ratchet teeth at the top of the time zone adjustable ring for engaging with the two engaging hooks. The dial plate is inserted into the time zone adjustable ring and provides a planetary idle wheel set by the periphery thereof to mesh with the inner gear ring part and the planetary basic gear. Hence, the dial plate can display a correct time.

12 Claims, 8 Drawing Sheets

CLOCK MOVEMENT WITH A DISPLAY FOR WORLD TIME ZONES

BACKGROUND OF THE INVENTION

1. Field of the Invention

The present invention relates to a clock movement with a display for world time zones, and particularly to a clock movement, with which an hour hand can provide a relative displacement by way of turning a time zone adjustable ring such that the dial plate thereof can show the time of a specific zone in the world directly.

2. Description of Related Art

It is known that the international exchange is getting more frequent and the transnational contact is getting popular due to the advance of the traffic and communication. In order to consider the factor with regard to the transmission of information and to the time difference, a clock possible to show the time of any other zone, or the so-called world time clock is developed to respond the necessity.

Mostly, a conventional world time clock at the dial thereof is printed with a world map and a local time is looked up in the world map. The deficiency involved in the conventional world time clock is that the dial appears too much complicated and it does not fulfill the criterion of human engineering from the standpoint of vision cognition and transmission.

Taking the U.S. Pat. No. 4,972,392 as an example, the world clock disclosed provides a 12-hour movement with a belt externally connecting with a time zone map to correspond to an hour ring with 24 equal hour divisions. The shortcoming of this world clock is that the belt drive may cause a frictional wear to influence the accuracy of time. In addition, the minute hand of the world time clock is hard to be read by means of the accustomed way.

Next, taking a simple type of world time clock as another example, the movement of this world time clock provides a 24-hour display and the periphery of the dial thereof engages with a time zone ring with 24 typical city names thereon to represent 24 time zones. When the local city name is turned to correspond to the local time in the time zone ring, the time of another related city can be figured out. However, the simple type of world time clock is also involved in a defect that the movement has to provide a 24-hour display. Moreover, the time zone ring is easily loosened after using a period of time caused by no locating device available for the time zone ring being steadily attached to the dial such that it may result in a difficulty of reading the time. Besides, the time zone ring on the simple type of world time clock is disposed to have a distance from the 24-hour graduation on the dial so that it is easy to occur a reading error. Furthermore, the dial has to be arranged with 24 graduations standing for 24 hours and the gap between two neighboring hour graduations is reduced in a limited space such that it is unfavorable for the reading of minute hand and it is not possible for the alarm being aligned accurately. This is the reason why the ordinary world time clock usually does not provide the alarm time.

SUMMARY OF THE INVENTION

An object of the present invention is to provide a clock movement with a display for world time zones, which has a 12-hour movement associated with a time zone adjustable ring to show the time in the respective time zone conveniently and accurately.

BRIEF DESCRIPTION OF THE DRAWINGS

The present invention can be more fully understood by referencing to the following detailed description and accompanying drawings, in which.

DETAILED DESCRIPTION OF THE PREFERRED EMBODIMENTS

Figure 1:
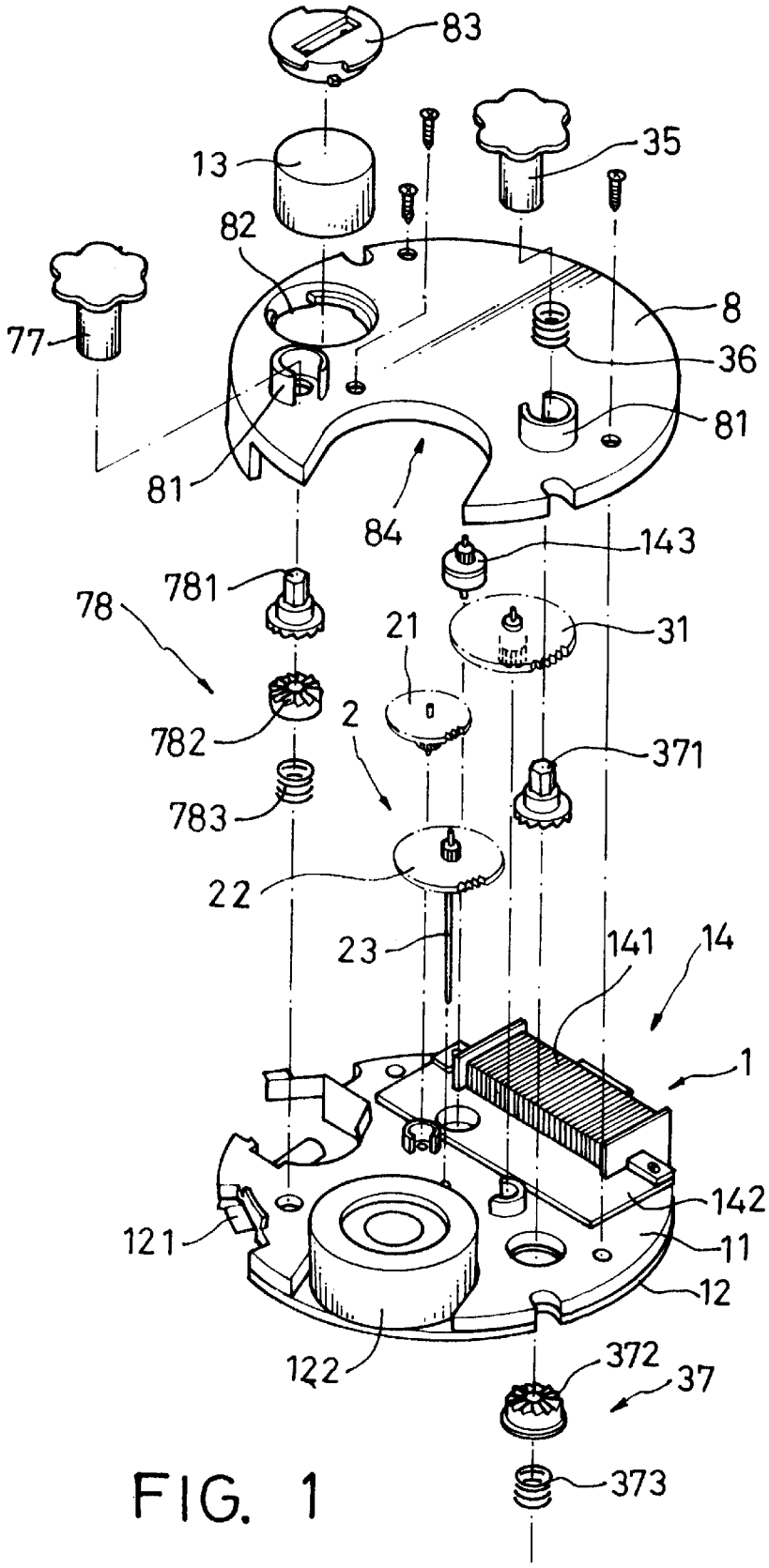
FIGS. 1 to 3 are exploded perspective view of a clock movement with a display for world time zones according to the present invention.
Figure 2:
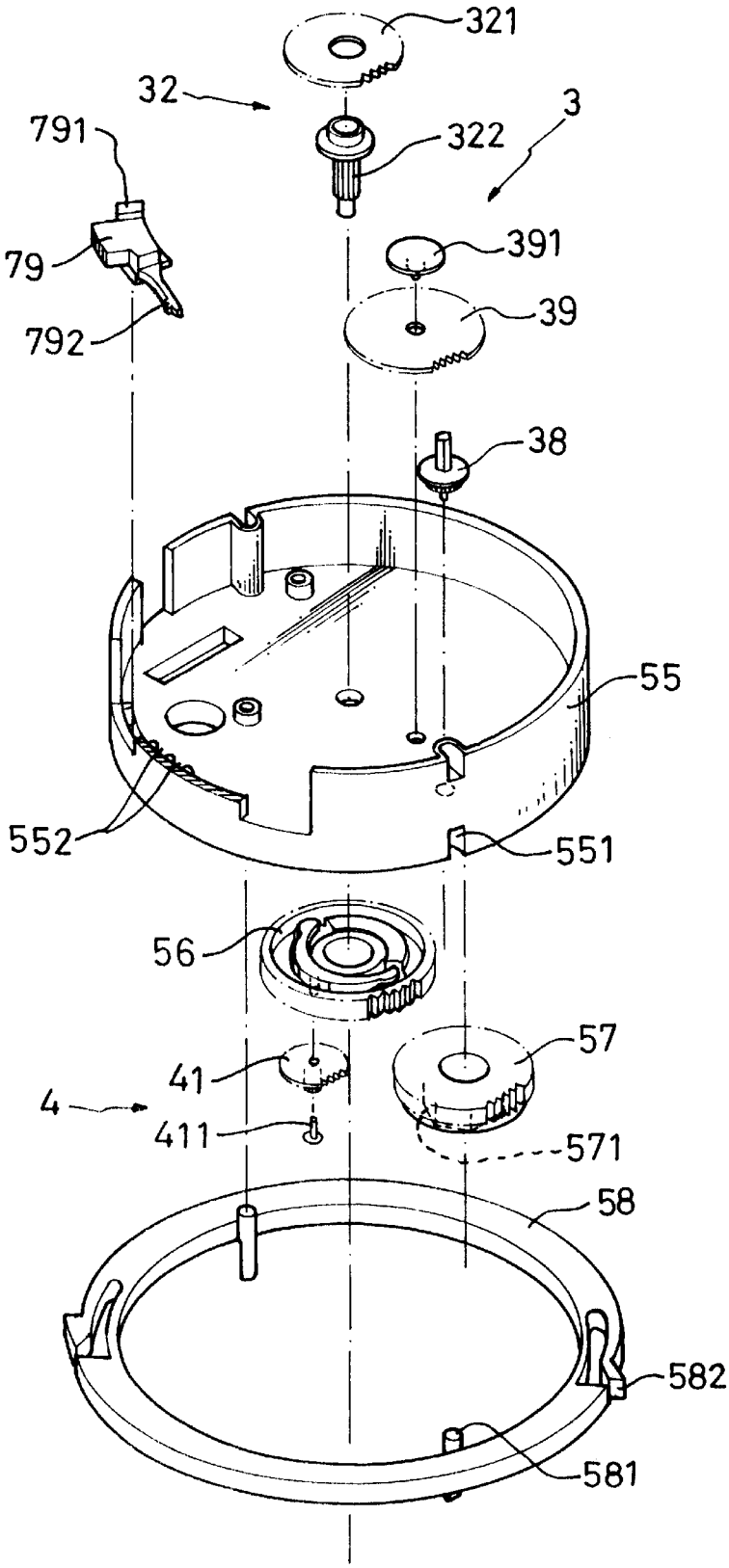
Figure 3:
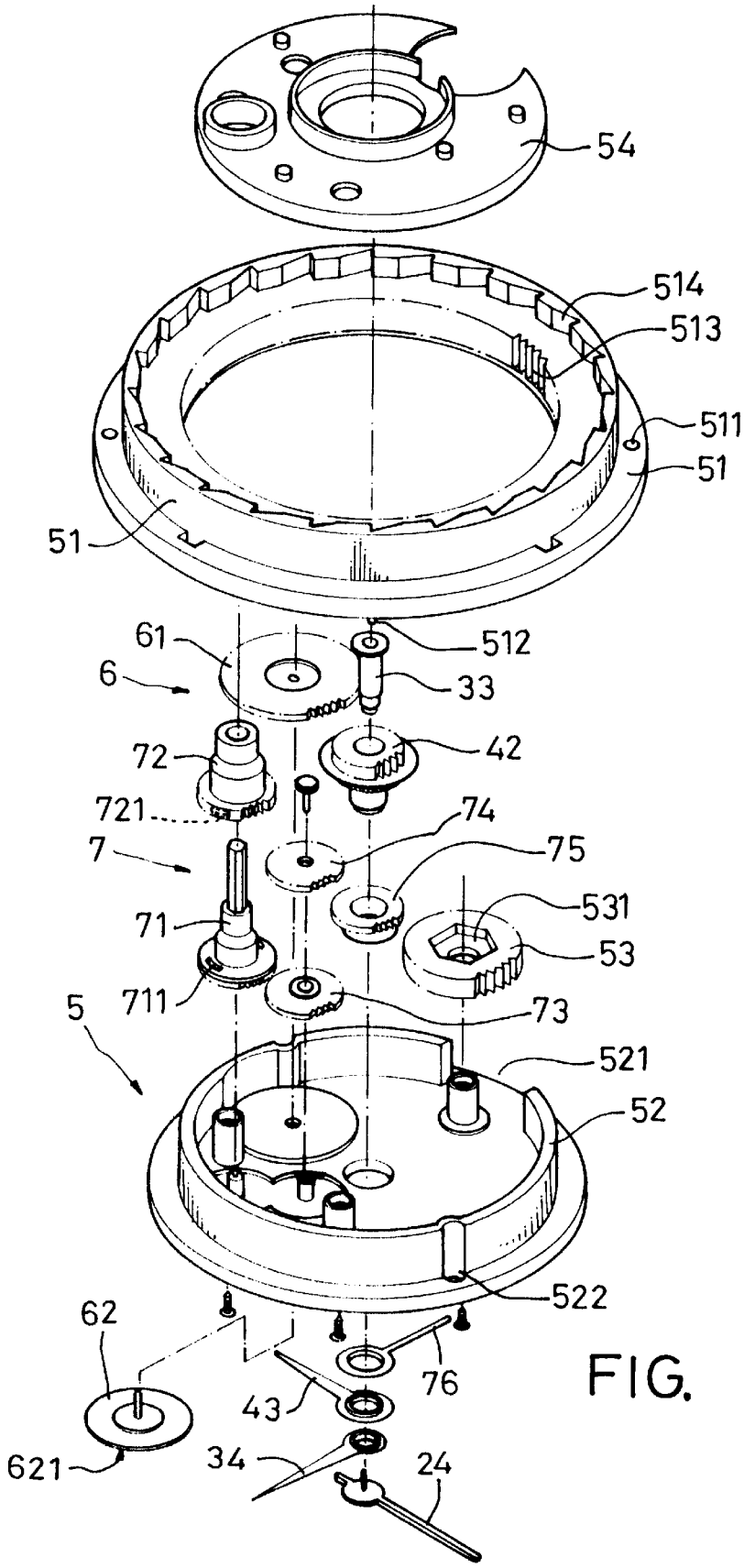
Figure 4:
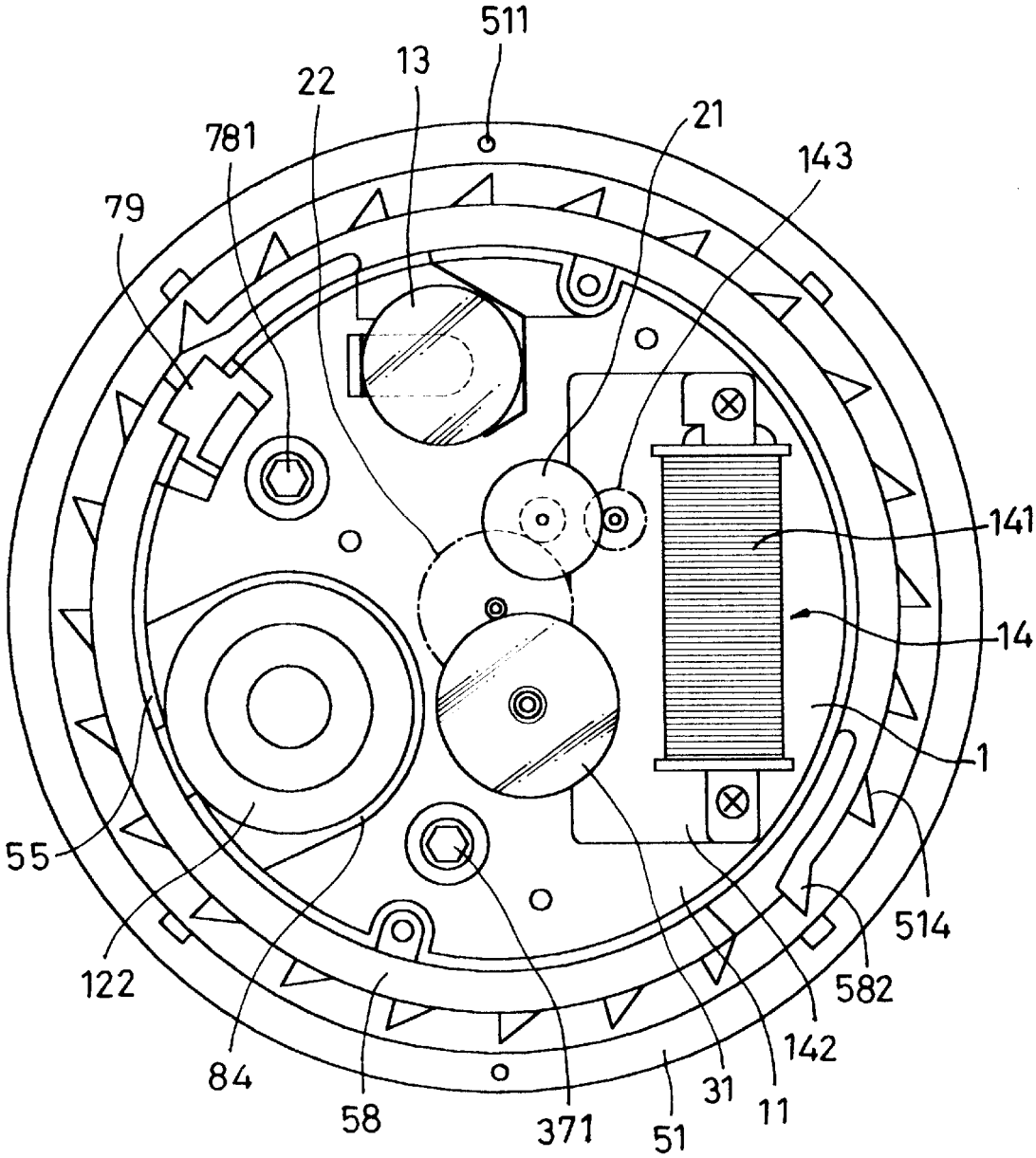
FIG. 4 is a plan view illustrating parts attached to a substrate of the clock movement with a display for world time zones according to the present invention shown in FIG. 1 after assembling.
Figure 5:
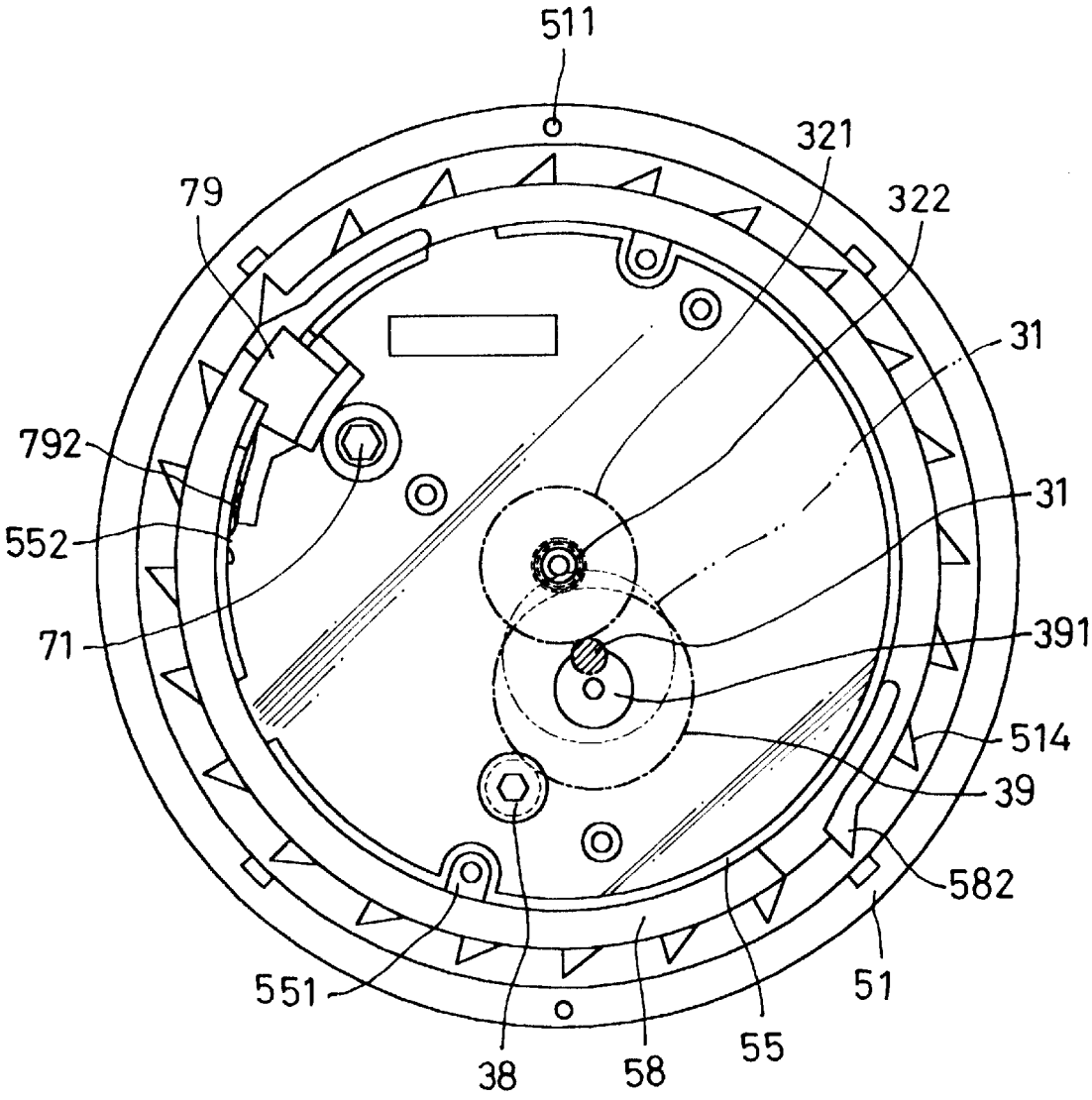
FIG. 5 is a plan view illustrating parts attached to an intermediate base of the clock movement with a display for world time zones according to the present invention shown in FIG. 2 after assembling.
Figure 6:
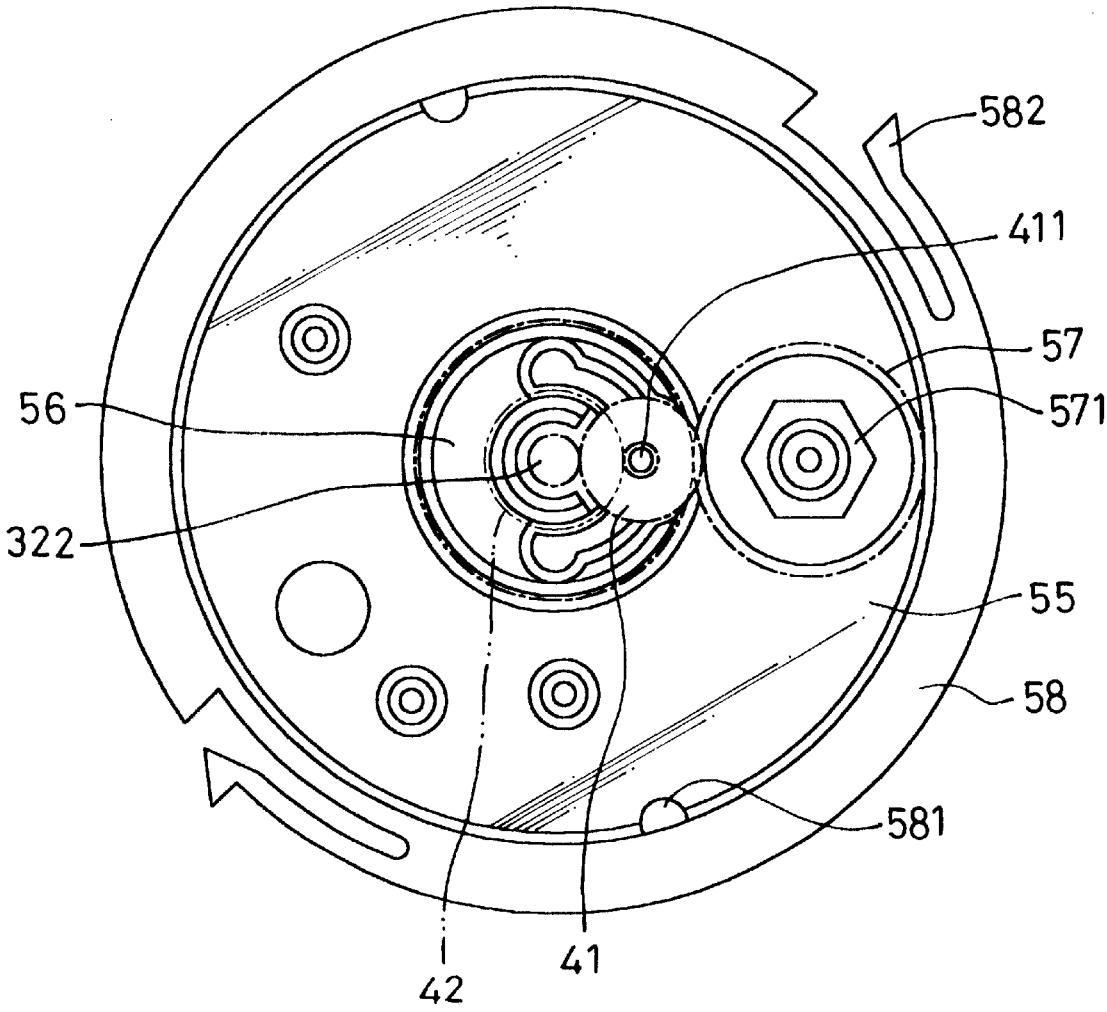
FIG. 6 is a rear view of FIG. 5.
Figure 7:
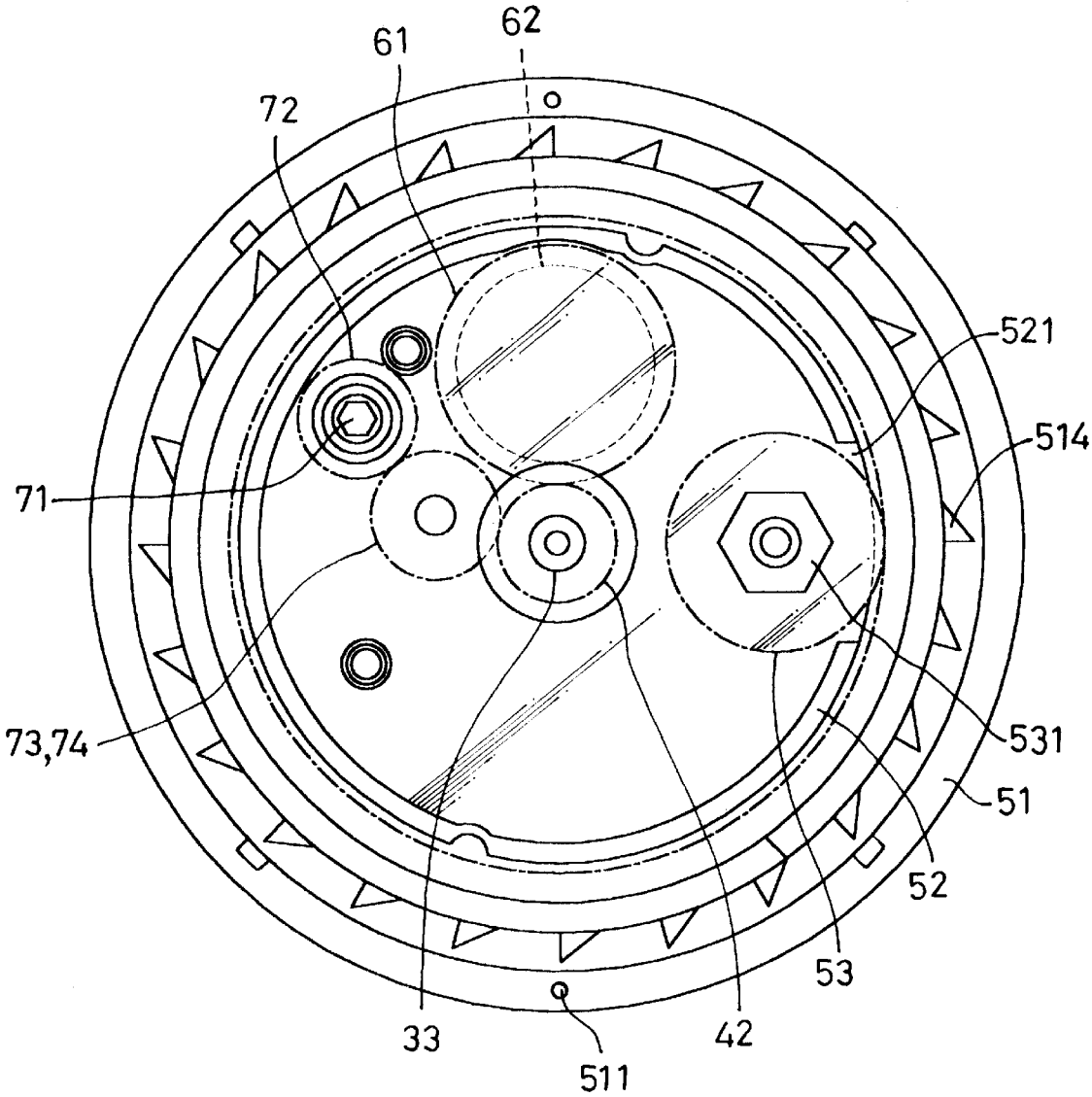
FIG. 7 is a plan view illustrating parts attached to a dial plate shown in FIG. 3 after assembling.
Figure 8:
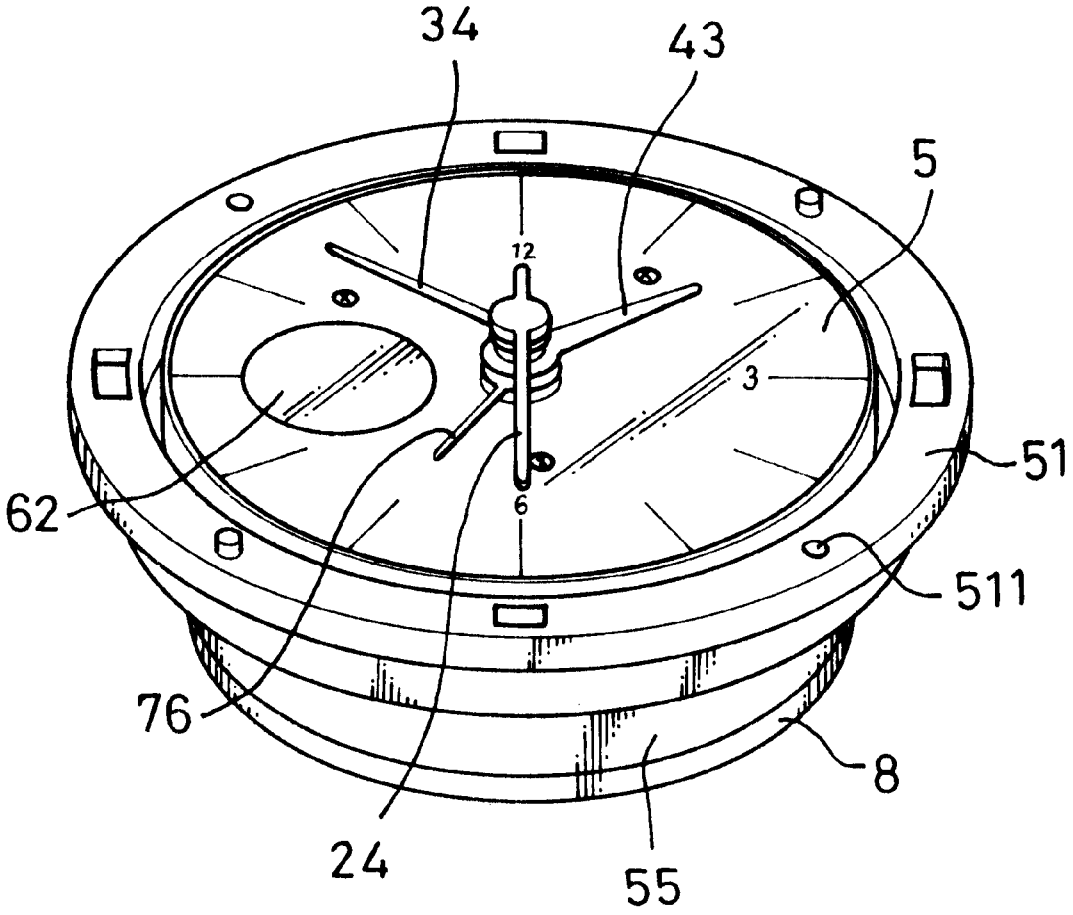
FIG. 8 is an assembled perspective view of the world time clock with the movement thereof.

Referring to FIGS. 1 to 8, a clock movement with a display for world time zones according to the present invention basically comprises a power source 1, a second counter 2, a minute counter 3, an hour counter 4, and a time zone display 5. In addition, the movement of the present invention further comprises a day-night display 6 and an alarm reset device 7.

Referring to FIGS. 1 and 4 again, the power source 1 is disposed above a double-layer substrate 11 and a circuit board 12, and the power source 1 provides a battery 13 mounted to the circuit board 12. Thus, the power can be supplied to a conventional stepping motor 14 composed of a coil 141, stator 142, and a rotor 143 so that the rotor 143 can rotate with a constant speed to transmit the power to the second counter 2.

The second counter 2 provides a front second wheel 21 is axially attached to the substrate 11 and meshes with the rotor 143 so as to be driven by the rotor 143. The front second wheel 21 further meshes with a second wheel 22 so that a second spindle under the second wheel 22 can rotate a revolution per minute. The second spindle 23 passes over a minute wheel set 32 and extends beyond the dial plate 52 to pivotally connect with a second hand/disk 24.

Referring to FIGS. 2 to 7, the minute counter 3 provides a front minute wheel 31, which is disposed on the substrate 11, to mesh with the second wheel 22 and the lower part of front minute wheel 31 passes over the substrate 11 and the circuit board 12 to mesh with a minute wheel set 32 so as to obtain an effect of speed reduction. The minute wheel set 32 at the bottom thereof connects with an axial tubing 33 and the axial tubing 33 extends through the dial plate 52 to fit with a minute hand 34 such that the minute hand 34 can turn 60 per revolution of the second hand/disk 24.

Wherein, the minute wheel set 32 provides a minute wheel 321 movably fits with a minute wheel spindle 322 and an advantage of the arrangement will be described hereinafter. As soon as a time adjusting knob 35 is pressed and turned, a spring 36 disposed in one of hollow posts 81 on a cover plate 8 is compressed to descend a ratchet set 37, which is composed of a ratchet tooth stem 371, a ratchet disk 372, and a spring 373, so as to connect with an adjustable idle wheel 38 disposed under the ratchet set 37. The idle wheel 38 rotates relative to a driven wheel 39, which has a shaft 391 attached to the intermediate base 55, such that the minute wheel spindle 322, which meshes with the driven wheel 39, can rotate to move the axial tubing 33 relative to the hour counter 4 for obtaining a purpose of time adjustment. The minute wheel 321 turns in a state of idling in spite of being driven by the front minute wheel 31 and the second spindle 23 keeps turning with a constant speed to avoid a possible error resulting from a stop of the second spindle 23 during the time correction.

The hour counter 4 axially connects with a planetary basic gear 56 at the bottom of the intermediate base 55 and a front hour wheel 41 of the hour counter 4 connects with the planetary basic gear 56 by way of a lower axial stem 411. The front hour wheel 41 further meshes with the minute wheel spindle 322 to rotate along with the minute wheel spindle 322 and can perform a planetary movement with the planetary basic gear 56. Besides, the front hour wheel 41 at the position of an intermediate plate 54 meshes with an hour wheel 42 such that the speed of the hour wheel 42 can be reduced to turn 30° per 60 minutes. Hence, the hour wheel 42 passes through an alarm time wheel 75 and the dial plate 52 and connects with an hour hand 43.

The time zone display 5 provides a time zone adjustable ring 51 to fit with the dial plate 52 and the time zone adjustable ring 51 has a plurality of ring holes 511 and/or projections 512 next to the periphery thereof to connect with a landmark ring (not shown). It is noted that the landmark ring with typical city names thereon corresponding to 24 time zones. The time zone adjustable ring 51 provides an inner gear ring 513 to mesh with a planetary idle gear 53, which axially connects with the dial plate 52 at a circumferential opening 521 thereof. Besides, the dial plate 52 at the upper part thereof connects with a relay plate 54 so that the relay plate 54 can be a partition for the day-night display 6 and the alarm reset device 7 being located over there. Furthermore, the intermediate base 55 at the lower center thereof axially connects with the planetary gear 56 and the minute wheel spindle 322 passes through a central hole of the intermediate base 55 and meshes with the front hour wheel 41, which is axially attached to the intermediate base 55. In addition, the planetary gear 56 further meshes with a planetary driven gear 57 and an angle projection 571 engages with an angle hole 531 in the planetary idle gear 53 such that a gear train can be constituted accordingly.

Moreover, a join ring 58 is mounted between the intermediate base 55 and the dial plate 52 and at least two upright locating posts 581 are attached to the inner circumference to insert into base recesses 551 and plate recesses 522 of the intermediate base 55 and the dial plate 52 respectively so that the intermediate base 55 and the dial plate 52 can be assembled together. Besides, the join ring 58 has at least two circumferential elastic engaging hooks 582 to engage with a ratchet ring 514 in the time zone adjustable ring 51 above the inner gear ring 513. Thus, as soon as the time zone adjustable ring 51 is turned to one of the time zones and the planetary idle gear 53 rotates with the planetary driven gear 57, the planetary gear 56 can driven by the planetary driven gear 57 to rotate the front hour wheel 41 with a planetary movement. Next, the hour wheel 42 can be turned along with he hour hand 43 on the dial plate 52 synchronously.

In fact, while the planetary base gear 56 is in a state of planetary movement, the front hour wheel 41 rotates about the minute wheel spindle 322 without interfering the movement of the planetary basic gear 56 so that it is not possible to generate an error of time reading.

Besides, the inner ratchet ring 514 is unidirectional and provides twenty-four ratchet teeth corresponding to the 24 typical city names of the 24 time zones on the landmark ring so that the time zone adjustable ring 51 can only turn in a reverse direction during being stirred with hand. In the mean time, the two engaging hooks 582 can selectively engage with one of the ratchet teeth of the inner ratchet ring 514 respectively to perform a sharp pause at an exact hour location.

Referring to FIGS. 3 and 7 again, the present invention further comprises a day-night display 6, which is possible for being known the state of daytime or the state of nighttime if it is necessary. The day-night display 6 provides a day-night gear 61 meshes with the hour wheel 42 and a day-night display disk 62 in front of the dial plate 52 has a shaft passing over the dial plate 52 to axially connect with the day-night gear 61 so that the day-night display disk 62 can run along with the hour heel 42. Wherein, the day-night display disk 62 (shown in FIG. 7) at the facial side thereof has two decoration marks 61 as day/night symbols to indicate the state of daytime and the state of nighttime respectively. Due to engaging with the hour wheel 42 constantly, the day-night gear 61 runs along with the hour wheel 42 so that the situations of day and night with regard to the local time of the user can be shown under a normal state. When the user moves the time zone adjustable ring 51 by hand, the hour wheel 42 may generate an opposite turning and the day-night gear 61 further turns along with the hour wheel 42. As soon as the day-night gear 61 is adjusted to a desired time zone, the displayed decoration mark 621 represents the situations of day-night of the local time. Hence, the 12-hour movement disclosed in the present invention can distinguish the state of daytime from the state of nighttime and display the time corresponding to the respective state.

Referring to FIGS. 1, 3, and 7 again, the present invention further comprises an alarm reset device 7 and the alarm reset device 7 provides an inner time setting wheel 71 to movably fit with an outer time setting wheel 72 so as to be axially attached to the dial plate 52 together. The outer time setting wheel 72 at a contact surface thereof at least has two projection pieces 721 and the inner time setting wheel 71 at a contact surface thereof at least has two locating recesses 711 corresponding to the projection pieces 71. Besides, the inner time setting wheel 71 meshes with a first idle wheel 73 and the outer time setting wheel 72 meshes with a second idle wheel 74, and the first idle wheel 73 and the second idle wheel 74 are disposed next to each other. The first idle wheel 73 and the second idle wheel 74 further meshes with an alarm wheel 75 and the hour wheel 42 respectively and the alarm wheel 75 passes through the center of the dial plate 52 to join an alarm hand 76. When an alarm adjusting knob 77 is turned to rotate a ratchet set 78 composed of a ratchet stem 781, a ratchet disk 782, and a spring 783 counterclockwise and rotate the inner time setting wheel 71 connecting with the ratchet set 78. The first idle wheel 73 and the alarm wheel 75 may turn counterclockwise till the alarm hand 76 indicates the alarm time. Moreover, it is preferable that the ratchet set 78 provides a unidirectional rotation.

Meanwhile, the hour wheel 42 keeps running to rotate the second idle wheel 74 and the outer time setting wheel 72 with the projection pieces 721 performing a circumferential movement on a facial side of the inner time setting wheel 71. As soon as the projection pieces 721 align with and fall into the locating recesses 711, the outer time setting wheel 72 descends abruptly such that an elastic contact plate 121 on a circuit board 12 becomes in a state of being not supported by the outer time setting wheel 72 and electrically contacts with the circuit board 12. Thus, a buzzer 122 can send out a buzzing sound to inform the user that the preset alarm time has been up.

At this time, the user can move an alarm switch 79 disposed at the periphery of the intermediate base 55 by hand to raise the elastic contact plate 121 again by way of a key jut 791 thereof so that the power source can be off to relieve the buzzer 122 from sending out the buzzing sound. Further, the alarm switch 79 extends outward an engaging projection 792 opposite the key jut 791 to engage with a two-step type of engaging groove 552 on the wall surface of the intermediate base 55 and the buzzer can be reset or relieved by means of the engaging projections 792.

A cover 8 is provided to be attached to the intermediate base 55 and at the outer surface thereof has two hollow posts 81 for receiving the alarm adjusting knob 77 and the time adjustable knob 35 fitting with the spring 36 respectively to control the rotations of the two ratchet sets 78, 37 respectively. Besides, a battery hole 82 is arranged on the cover 8 corresponding to the battery 13 for locating the battery 13 and a battery cover 83 is provided to enclose the battery 13. Also, a cover recess 84 is provided on the cover 8 corresponding to the buzzer 122 so that the buzzer 122 can extend outward as soon as the cover 8 is in a state of covering.

Referring to FIGS. 1 to 8 again, while the clock movement with a display for world time zones of the present invention is in use, the user aligns the local landmark of Taipei with a fixed point such as the 12 o'clock first and then the time adjusting knob 35 is turned to calibrate the minute counter 3 and the hour counter 4 in accordance with the local time. Next, the time shown on the day-night display 62 can be read by way of the decoration mark 621 thereof such as the time being adjusted to 12 o'clock at noon. In order to look into another time zone such as the time in Chicago, it is only necessary to move the time zone adjustable ring 51 to move the time zone display 5 and the hour counter 4 synchronously and the landmark of Chicago is aligned with the direction of 12 o'clock such that the day-night display disk 61 shows a decoration mark 621 representing the night at the present time with the hour hand 43 indicating 10 o'clock and it means the present time in Chicago is 10 o'clock at night, which is not appropriate to make a business phone call.

Further, if the user intends to contact with his customer at 9:30 AM in Chicago, the time adjusting knob 35 is turned in accordance with the preceding step to obtain a local time in Chicago and then the alarm adjusting knob 77 is turned immediately to actuate the alarm reset device 7 and the alarm hand 76 is moved to indicate 9:30 AM. As soon as the two projection pieces 721 of the outer time setting wheel 72 fall into the two locating grooves 711 of the inner time setting wheel 71, the buzzer 122 emits a buzzing sound. Right at the time, the local user (the local time is 11:30 PM) can pick up the phone to communicate with the customer in Chicago.

It is appreciated that the advantages of the present invention can be summarized hereinafter:

(1) It is easy for the user to read the time. Because the present invention adopts a 12-hour movement to display the time so that the local time and other time zones can be easily read without changing the accustomed way for reading the time.

(2) It is easily operated and offers accurate time information. In case of other time zones being checked, it is only necessary to move the time zone adjustable ring such that the hour counter can perform a planetary movement on the planetary basic gear and it is possible for the hour counter to move along with exact hour graduation for the specific time at both places respectively or for the time difference between both places being distinguishable easily and conveniently.

(3) It provides a function of day-night reading. The difference between decoration marks shown on the day-night display disk is possible for the user to differentiate the state of daytime or nighttime for a certain time zone easily.

(4) It provides a function of alarm reset. The movement of the present invention offers the exact same way for reading the time as the conventional 12-hour movement and the way for resetting and relieving the alarm for both movements are almost identical so that it is possible to avoid the shortcoming that it is hard to set the alarm time due to too small a clearance between two neighboring hour graduations. In addition, the alarm time can be set after another time zone having been adjusted in the present invention and the user can be reminded that the preset time is up during the alarm being buzzing.

While the invention has been described with reference to a preferred embodiment thereof, it is to be understood that modifications or variations may be easily made without departing from the spirit of this invention, which is defined by the appended claims.

What is claimed is:

1. A clock movement with a display for world time zones, comprising a power source, a second counter, a minute counter with a minute wheel set, an hour counter with a front hour wheel, a dial plate and a time zone display; wherein the time zone display further comprises:

an intermediate base with a bottom and mounted to a rear of the dial plate; a planetary basic gear axially attached to a central portion of the bottom, the planetary basic gear connecting with the front hour wheel; a join ring located between the intermediate base and the dial plate and including at least two circumferential elastic engaging hooks;

a planetary driven gear engaged with the planetary basic gear; a planetary idle gear driven by the planetary driven gear;

a time zone adjustable ring movably mounted on the dial plate and including an inner gear ring meshing with the planetary idle gear, and an inner ratchet ring with a plurality of ratchet teeth engaging the two engaging hooks;

whereby, the dial plate can display a correct time and whereby manually moving the time zone adjustable ring relative to the dial plate also moves the hour counter.

2. The clock movement with a display for world time zones according to claim 1, wherein the power source is disposed above a substrate and a circuit board, and includes a stepping motor with a rotor rotating with a constant speed and power therefor being supplied by a battery;

the second counter includes a front second wheel meshing with the rotor and a second wheel respectively, the second wheel having a downwardly extending second spindle connected to a second hand/disk on the dial plate;

the minute counter includes a front minute wheel meshing with the second wheel, a lower part thereof further meshing with a minute wheel set, the minute wheel set at a bottom thereof connecting with an axial tubing and being passed through by the second spindle, the axial tubing at an end thereof connecting with a minute hand; and the hour counter includes the front hour wheel to mesh with the minute wheel set and an hour wheel respectively, the hour wheel being passed through by the axial tubing and an end thereof connecting with an hour hand.

3. The clock movement with a display for world time zones according to claim 1, wherein the minute wheel set includes a front minute wheel movably fitting with a minute wheel spindle disposed on the intermediate base and passing through the planetary basic gear so as to mesh with the front hour wheel; and a time adjusting knob, such that when the time adjusting knob is turned, an adjustable idle wheel is rotated and a follower wheel meshed with the adjustable idle wheel is turned to rotate the minute wheel spindle so that the time can be adjusted.

4. The clock movement with a display for world time zones according to claim 3, wherein the time adjusting knob fits with a spring in a hollow post of a cover and includes a ratchet set having a ratchet tooth stem, a ratchet tooth disk and a spring mounted between the time adjusting knob and the adjustable idle wheel such that the time adjusting knob can only be turned in one direction.

5. The clock movement with a display for world time zones according to claim 1, wherein the axial tubing is integral with the minute wheel set.

6. The clock movement with a display for world time zones according to claim 1, wherein the join ring at an inner circumference thereof has at least two locating posts inserted into base recesses of the intermediate base and plate recesses of the dial plate respectively so that the join ring, the intermediate base and the dial plate are joined together.

7. The clock movement with a display for world time zones according to claim 1, wherein the inner ratchet ring has twenty four unidirectional ratchet teeth.

8. The clock movement with a display for world time zones according to claim 1, further comprising a day-night display disposed next to the hour wheel meshing with a day-night gear; and including a day-night display disk axially connected with the day-night gear such that the day-night display disk turns along with the hour wheel.

9. The clock movement with a display for world time zones according to claim 1, further comprising an alarm reset device including an inner time setting wheel movably fitting with an outer time setting wheel such that both time setting wheels are axially attached to the dial plate with a contact surface provided on the respective time setting wheel having at least two projection pieces and two locating grooves; and a first idle wheel and a second idle wheel are axially disposed to mesh with the inner time setting wheel and the outer time setting wheel respectively, whereby the hour wheel passes through an alarm wheel and connects with an hour hand and an alarm hand respectively so as to mesh with the second idle wheel and the first idle wheel respectively;

such that, when the alarm adjusting knob is turned, the inner time setting wheel, the first idle wheel, the alarm wheel and the alarm hand are rotated respectively to reset the alarm time; the front hour wheel keeps running to rotate the second idle wheel and the outer time setting wheel with the projection pieces performing a circumferential movement on a facial side of the inner time setting wheel; as soon as the projection pieces fall into the locating recesses, the outer time setting wheel descends such that an elastic contact plate on a circuit board becomes unsupported by the outer time setting wheel and electrically contacts the circuit board with a buzzer sending out a warning sound.

10. The clock movement with a display for world time zones according to claim 9, wherein the alarm adjusting knob is disposed in a hollow post on the cover and a ratchet set including a ratchet stem, a ratchet disk, and a spring is disposed between the alarm adjusting knob and the inner time setting wheel such that the alarm adjusting knob can only turn in one direction.

11. The clock movement with a display for world time zones according to claim 9, wherein an alarm switch is disposed at a periphery of the intermediate base and the alarm switch at a lateral side thereof has a key jut to raise an elastic plate as soon as the alarm switch is moved by hand such that the buzzer is turned off.

12. The clock movement with a display for world time zones according to claim 11, wherein the alarm switch includes an outwardly engaging projection opposite the key jut engaging a two-stage engaging groove in a wall surface of the intermediate base for resetting or relieving the buzzer.

* * * * *